US011752536B2

(12) United States Patent
Yamauchi et al.

(10) Patent No.: US 11,752,536 B2
(45) Date of Patent: Sep. 12, 2023

(54) EXPANSION FORMING APPARATUS

(71) Applicant: SUMITOMO HEAVY INDUSTRIES, LTD., Tokyo (JP)

(72) Inventors: Kei Yamauchi, Ehime (JP); Eiji Kouyama, Ehime (JP); Kiyomasa Koukami, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/175,072

(22) Filed: Feb. 12, 2021

(65) Prior Publication Data

US 2021/0162481 A1 Jun. 3, 2021

Related U.S. Application Data

(63) Continuation of application No. PCT/JP2019/037812, filed on Sep. 26, 2019.

(30) Foreign Application Priority Data

Oct. 1, 2018 (JP) ..... 2018-186313

(51) Int. Cl.
*B21D 26/10* (2006.01)
*B21D 26/041* (2011.01)

(52) U.S. Cl.
CPC ..... *B21D 26/10* (2013.01); *B21D 26/041* (2013.01)

(58) Field of Classification Search
CPC .... B21D 26/02; B21D 26/027; B21D 26/033; B21D 26/039; B21D 26/041; B21D 26/043; B21D 26/045; B21D 26/10; H05B 3/03
See application file for complete search history.

(56) References Cited

U.S. PATENT DOCUMENTS 3,728,887 A * 4/1973 Bachmann ..... B21J 9/08 72/318
3,933,020 A * 1/1976 Orr ..... B21D 11/02 29/445
5,435,163 A * 7/1995 Schafer ..... B21D 26/043 72/58
5,953,945 A * 9/1999 Horton ..... B21D 26/045 72/58

(Continued)

FOREIGN PATENT DOCUMENTS

DE 102014003350 A1 * 9/2015 ..... B21D 26/025
DE 102016112157 A1 * 1/2018 ..... B21D 26/00

(Continued)

OTHER PUBLICATIONS

CN 104162948A, Chu et al. Nov. 2014.*

(Continued)

*Primary Examiner* — Edward T Tolan
(74) *Attorney, Agent, or Firm* — Michael Best & Friedrich LLP

(57) ABSTRACT

An expansion forming apparatus that shapes a metal material with a die includes an electrode that comes into contact with the metal material and performs energization heating, and an electrode mounting unit having an electrode movement actuator that moves the electrode along an extension direction of the metal material during heating.

16 Claims, 11 Drawing Sheets

(56) References Cited

U.S. PATENT DOCUMENTS

| | | | | |
|---|---|---|---|---|
| 6,601,423 | B1 * | 8/2003 | Peterson | B21D 3/14 72/58 |
| 7,464,572 | B2 * | 12/2008 | Miyanaga | B21D 26/033 72/58 |
| 8,408,034 | B2 * | 4/2013 | Ishihara | B21D 37/16 72/58 |
| 9,392,644 | B2 * | 7/2016 | Nojiri | H05B 3/0009 |
| 10,040,110 | B2 | 8/2018 | Ishizuka et al. | |
| 2007/0101786 | A1 * | 5/2007 | Yang | B21D 26/041 72/61 |
| 2008/0307848 | A1 * | 12/2008 | Hori | B21C 37/155 72/58 |
| 2010/0269559 | A1 * | 10/2010 | Ishiguro | C21D 1/40 72/364 |
| 2014/0123722 | A1 | 5/2014 | Nojiri et al. | |
| 2015/0060427 | A1 * | 3/2015 | Hwang | B23K 11/0026 219/149 |
| 2017/0095853 | A1 * | 4/2017 | Ishizuka | B21D 26/043 |
| 2018/0361458 | A1 | 12/2018 | Ishizuka et al. | |

FOREIGN PATENT DOCUMENTS

| | | | | |
|---|---|---|---|---|
| FR | 2933321 | A1 * | 1/2010 | B21D 26/10 |
| JP | S51-018313 | U1 | 2/1976 | |
| JP | 2000-233235 | A | 8/2000 | |
| JP | 2000-317537 | A | 11/2000 | |
| JP | 2005-324209 | A | 11/2005 | |
| JP | 2009-220141 | A | 10/2009 | |
| JP | 2015-160228 | A | 9/2015 | |
| JP | 2016-002578 | A | 1/2016 | |
| JP | 2016-129891 | A | 7/2016 | |
| WO | WO-2017/150110 | A1 | 9/2017 | |

OTHER PUBLICATIONS

International Search Report issued in Application No. PCT/JP2019/037812, dated Nov. 12, 2019.

Search Report issued in European Application No. 19869015.8, dated Oct. 22, 2021.

* cited by examiner

EXPANSION FORMING APPARATUS

RELATED APPLICATIONS

The contents of Japanese Patent Application No. 2018-186313, and of International Patent Application No. PCT/JP2019/037812, on the basis of each of which priority benefits are claimed in an accompanying application data sheet, are in their entirety incorporated herein by reference.

BACKGROUND

Technical Field

A certain embodiment of the present invention relates to an expansion forming apparatus.

Description of Related Art

An expansion forming apparatus that performs forming by mounting electrodes to both end portions in a longitudinal direction of a metal pipe material, increasing the temperature of the metal pipe material with Joule heating by energization, and supplying high-pressure air into the metal pipe material is known (refer to, for example, the related art).

SUMMARY

According to an embodiment of the present invention, there is provided an expansion forming apparatus that shapes a metal material with a die, including:

an electrode that comes into contact with the metal material and performs energization heating; and an electrode mounting unit having an electrode movement actuator that moves the electrode along an extension direction of the metal material during heating.

DETAILED DESCRIPTION

As described above, in a case where the temperature of the metal pipe material is increased due to the Joule heating by energization, the metal pipe material extends in the longitudinal direction thereof due to thermal expansion. In that case, in a case where both end portions of the metal pipe material are restrained by the electrodes, stress is generated in the longitudinal direction of the metal pipe material to cause deformation, and further, buckling occurs, so that there is a concern that forming failure may occur.

It is desirable to perform expansion forming of an appropriate metal material.

According to the present invention, even in a case where the metal material extends in the longitudinal direction thereof due to thermal expansion of the energization heating, the electrode can be moved along the extension direction of the metal material by the electrode movement actuator, and therefore, it becomes possible to effectively avoid deformation or buckling of the metal material and perform good expansion forming.

An embodiment of the present invention will be described based on the drawings.

Figure 1:
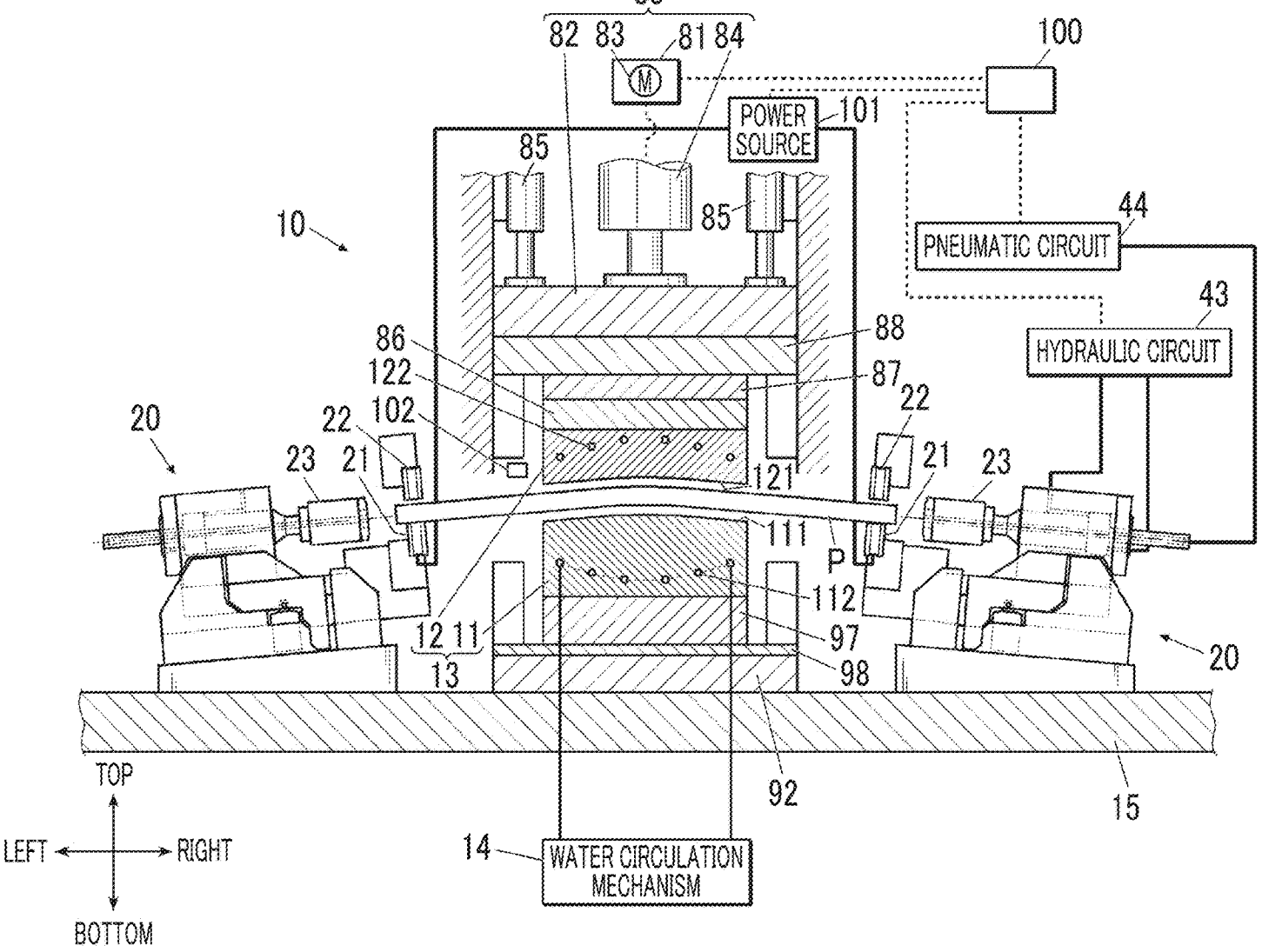
FIG. 1 is a schematic configuration diagram showing an expansion forming apparatus according to an embodiment of the present invention.

This embodiment exemplifies an expansion forming apparatus 10 that shapes a metal pipe as a metal material by blow forming. FIG. 1 is a schematic configuration diagram showing the expansion forming apparatus 10.

Overview of Expansion Forming Apparatus

The expansion forming apparatus 10 is installed on a horizontal plane. Then, the vertical upper side with respect to the horizontal plane on which the expansion forming apparatus 10 is installed is referred to as "top", the vertical lower side is referred to as "bottom", one side in one direction parallel to the horizontal plane (the left side on the paper surface of FIG. 1) is referred to as "left", and the opposite side (the right side on the paper of FIG. 1) is referred to as "right". Further, the front side which is perpendicular to the paper surface of FIG. 1 is referred to as "front" and the back side is referred to as "rear".

The expansion forming apparatus 10 includes a blow-forming die 13 composed of a lower die 11 and an upper die 12 which are paired with each other, an upper die drive mechanism 80 that moves the upper die 12, a pair of pipe holding mechanisms 20 that respectively hold a right end portion and a left end portion of a metal pipe material P on both the right and left sides with the lower die 11 and the upper die 12 interposed therebetween, a water circulation mechanism 14 that forcibly cools the blow-forming die 13 with water, a control device 100 that controls each of the above configurations, and a base stage 15 that supports almost the entire configuration of the apparatus on the upper surface.

The expansion forming apparatus 10 is installed such that the upper surface of the base stage 15 is horizontal.

The lower die 11 is configured with a steel block, has a recessed portion 111 provided on the upper surface thereof to correspond to a forming shape, and has a cooling water passage 112 formed in the interior.

The upper die 12 is configured with a steel block, has a recessed portion 121 provided on the lower surface thereof to correspond to the forming shape, and has a cooling water passage 122 formed in the interior.

The water circulation mechanism 14 is connected to the cooling water passages 112 and 122, and cooling water is supplied thereto by a pump.

In a state where the lower die 11 and the upper die 12 are in close contact with each other, the recessed portion 111 and the recessed portion 121 form a space having a target shape into which the metal pipe material P is to be formed.

The target shape is a shape which is curved or bent in the middle with respect to a linear shape parallel to the right-left direction, so that both right and left end portions are inclined downward. The metal pipe material P is bent or curved in the same manner as the target shape. However, the metal pipe material P has an outer diameter smaller than that of the target shape over the entire length, and is formed into the target shape in the process of expansion forming.

Therefore, the metal pipe material P is held by the pair of pipe holding mechanisms 20 such that both end portions thereof are directed in the same direction as the target shapes by the lower die 11 and the upper die 12.

Specifically, the right end portion of the metal pipe material P is held by the pipe holding mechanism 20 on the right side so as to be inclined slightly downward with respect to the right direction to be directed diagonally downward to the right. Further, the left end portion of the metal pipe material P is held by the pipe holding mechanism 20 on the left side so as to be inclined slightly downward with respect to the left direction to be directed diagonally downward to the left.

A lower die holder 97, a lower die base plate 98, and a slide 92, which are stacked in order downward, are provided on the lower side of the lower die 11.

The upper die drive mechanism 80 includes a first upper die holder 86, a second upper die holder 87, and an upper die base plate 88, which are stacked in order upward from the upper side of the upper die 12.

Further, the upper die drive mechanism 80 includes a slide 82 that moves the upper die 12 such that the upper die 12 and the lower die 11 are combined with each other, a pull-back cylinder 85 as an actuator that generates a force for pulling the slide 82 upward, a main cylinder 84 as a drive source for lowering and pressurizing the slide 82, a hydraulic pump 81 that supplies pressure oil to the main cylinder 84, a servomotor 83 that controls the amount of fluid with respect to the hydraulic pump 81, a hydraulic pump (not shown) that supplies pressure oil to the pull-back cylinder 85, and a motor (not shown) that serves as a drive source of the hydraulic pump.

The slide 82 is equipped with a position sensor such as a linear sensor for detecting a position in an up-down direction and a movement speed, and a load sensor such as a load cell for detecting the load of the upper die 12.

The position sensor or the load sensor of the upper die drive mechanism 80 is not essential and can be omitted.

Further, in a case where hydraulic pressure is used in the upper die drive mechanism 80, a measurement device that measures the hydraulic pressure can be used instead of the load sensor.

The control device 100 includes a CPU (Central Processing Unit), a storage device that stores a control program and control data, and a memory in which the CPU expands the data. In the control device 100, the CPU executes the control program in the storage device to execute the forming operation control by the expansion forming apparatus 10.

Further, the expansion forming apparatus 10 includes a radiation thermometer 102 for measuring the temperature of the metal pipe material P. However, the radiation thermometer is only an example of a temperature detection unit, and a contact type temperature sensor such as a thermocouple may be provided.

Pipe Holding Mechanism: Schematic Configuration

The pipe holding mechanism 20 is disposed one on each of the right and left sides of the blow-forming die 13 (hereinafter, simply referred to as a die 13) on the base stage 15.

The pipe holding mechanism 20 on the right side holds one end portion directed diagonally downward to the right, of the metal pipe material P in which the direction thereof is determined by the die 13, and the pipe holding mechanism 20 on the left side holds the other end portion directed diagonally downward to the left, of the metal pipe material P in which the direction thereof is determined by the die 13.

The pipe holding mechanism 20 on the right side and the pipe holding mechanism 20 on the left side have the same structure except that the configuration of each of them is fixed on the base stage 15 at an angle adjusted according to the inclination of each of the end portions of the metal pipe material P to be held. Therefore, the following description is mainly performed on the pipe holding mechanism 20 on the right side.

Figure 2:
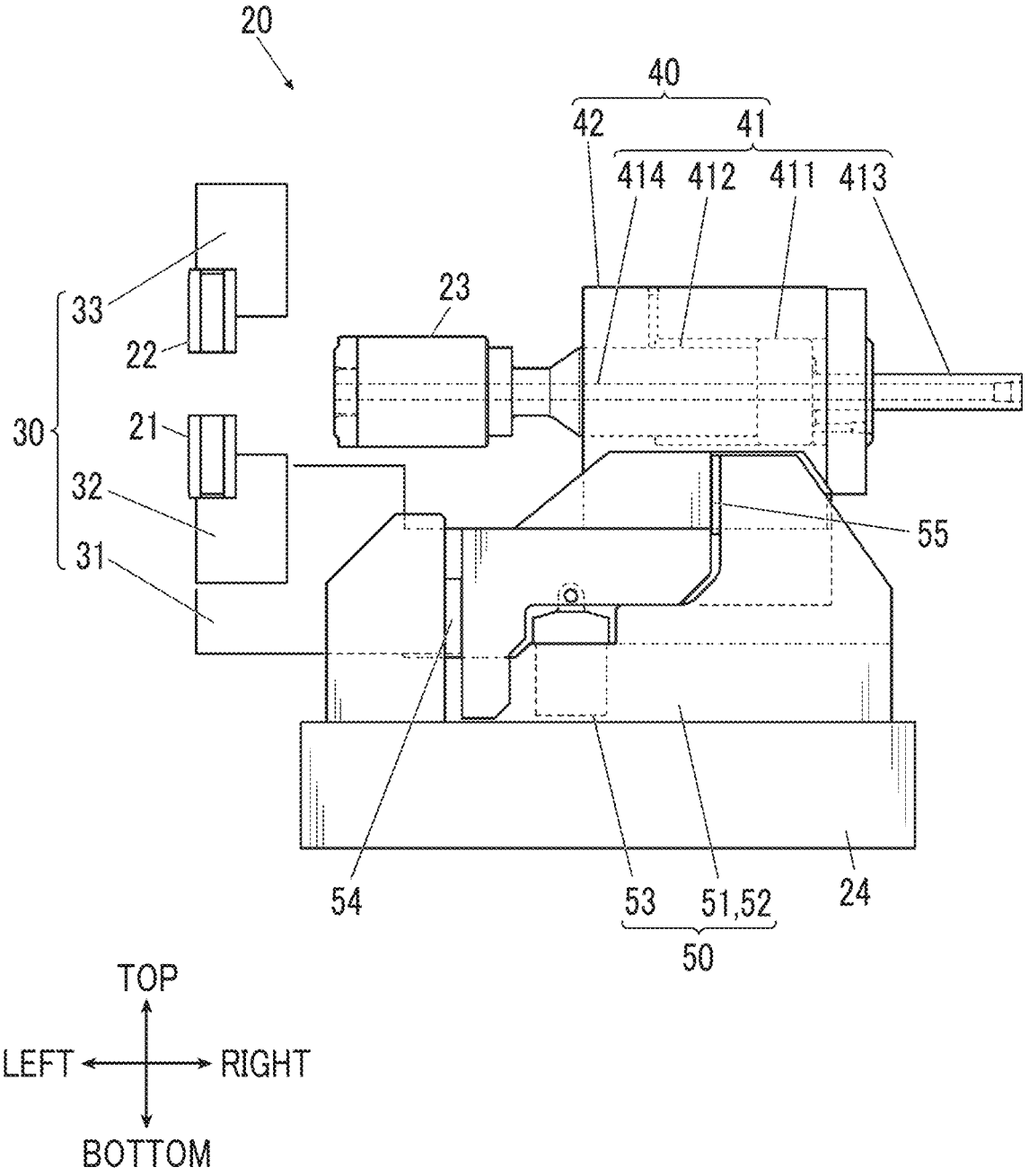
FIG. 2 is a front view of a pipe holding mechanism of the expansion forming apparatus of FIG. 1.
Figure 3:
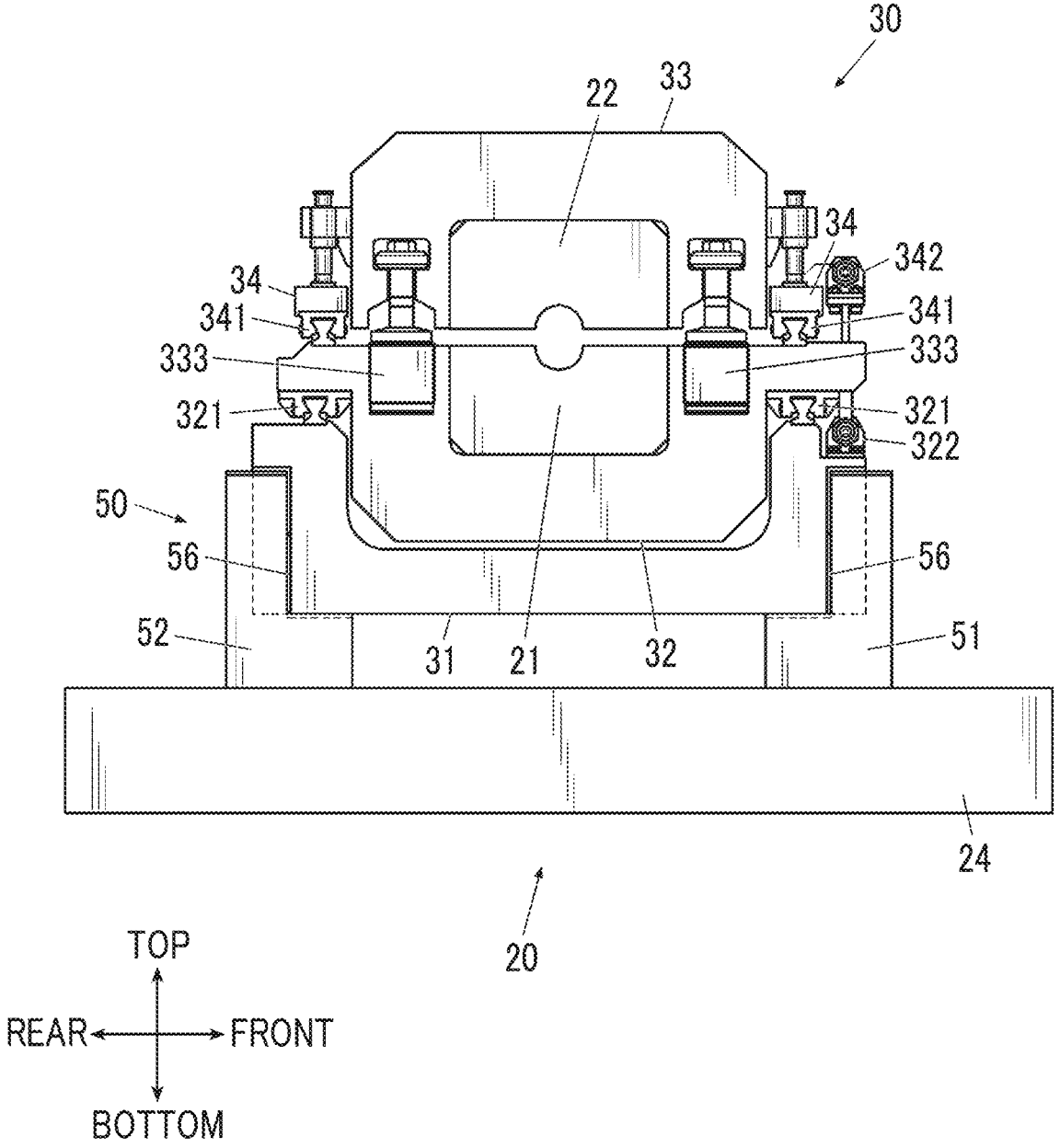
FIG. 3 is a left side view of the pipe holding mechanism.
Figure 4:
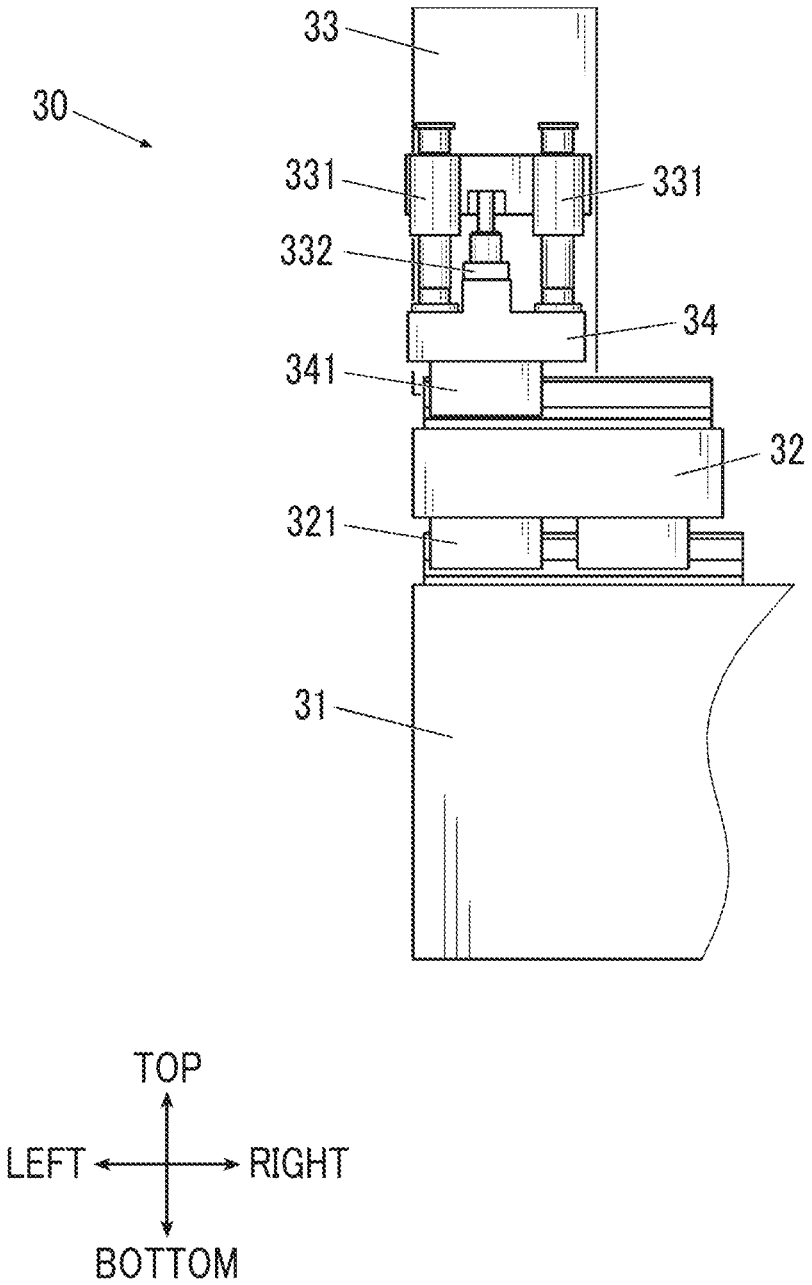
FIG. 4 is a partially enlarged view of an electrode mounting unit provided in the pipe holding mechanism.

FIG. 2 is a front view of the pipe holding mechanism 20 on the right side, FIG. 3 is a left side view, and FIG. 4 is a partially enlarged view of an electrode mounting unit 30 (described later). The pipe holding mechanism 20 on the right side is installed on the upper surface of the base stage 15 in a state where the entire configuration thereof is inclined according to the inclination angle of the right end portion of the metal pipe material P to be held, as described above. However, in FIGS. 2 to 4, for simplification and clarification of the description, the pipe holding mechanism 20 is shown in a state where the entire configuration thereof is not inclined, that is, in a direction in which the pipe holding mechanism 20 holds the right end portion of the metal pipe material P parallel to the right-left direction.

The pipe holding mechanism 20 includes a lower electrode 21 and an upper electrode 22 which are a pair of electrodes that grip the right end portion of the metal pipe material P, a nozzle 23 that supplies a compressed gas from the right end portion to the inside of the metal pipe material P, the electrode mounting unit 30 that supports the lower electrode 21 and the upper electrode 22, a nozzle mounting unit 40 that supports the nozzle 23, a lifting and lowering mechanism. 50 that lifts and lowers the lower electrode 21, the upper electrode 22, and the nozzle 23, and a unit base 24 that supports all of these configurations.

Pipe Holding Mechanism: Unit Base

The unit base 24 is a rectangular plate-shaped block when viewed in a plan view, which supports the electrode mounting unit 30 and the nozzle mounting unit 40 on the upper surface through the lifting and lowering mechanism 50.

The unit base 24 can be mounted on and dismounted from the upper surface of the base stage 15, which is a horizontal plane, by fixing means such as a bolt.

The pipe holding mechanism 20 has a plurality of unit bases 24 in which the inclination angles of the upper surfaces are different from each other, and by exchanging these unit bases, it is possible to collectively change and regulate the inclination angles of the lower electrode 21, the upper electrode 22, the nozzle 23, the electrode mounting unit 30, the nozzle mounting unit 40, and the lifting and lowering mechanism 50.

Then, in this way, the unit base 24 performs adjustment such that the electrode mounting unit 30 can move the lower electrode 21 and the upper electrode 22 along the extension direction of each end portion of the metal pipe material P having a direction that is defined by the blow-forming die 13.

The "extension direction of an end portion" refers to a direction in which the center line at the one-side end portion of the metal pipe material P linearly extends, or a vector direction along the direction in which the one-side end portion of the metal pipe material P is directed.

Further, similarly, the unit base 24 performs adjustment such that the nozzle mounting unit 40 can move the nozzle 23 along the extension direction of each end portion of the metal pipe material P having a direction that is defined by the blow-forming die 13.

That is, the unit base 24 functions as an electrode adjustment unit and a nozzle adjustment unit.

As described above, in a case where the extension direction of the center line of the right end portion of the metal pipe material P which is defined by the blow-forming die 13 is a direction diagonally downward to the right (there is no inclination in the front-rear direction), the upper surface of the unit base 24 is an inclined surface inclined in the direction in which the right side is lowered with respect to the horizontal plane around an axis along the front-rear direction, and the inclination angle thereof coincides with the inclination angle of the extension direction of the right end portion of the metal pipe material P.

Pipe Holding Mechanism: Lifting and Lowering Mechanism

The lifting and lowering mechanism 50 includes a pair of front and rear lifting and lowering frame bases 51 and 52 which are mounted on the upper surface of the unit base 24, and a lifting and lowering actuator 53 that imparts a lifting and lowering motion to a lifting and lowering frame 31 of the electrode mounting unit 30, which is supported by the lifting and lowering frame bases 51 and 52 so as to be able to move up and down along the direction perpendicular to the upper surface of the unit base 24.

The lifting and lowering frame bases 51 and 52 are detachably mounted on the upper surface of the unit base 24 by fastening means such as a bolt.

Then, the lifting and lowering frame base 51 on the front side and the lifting and lowering frame base 52 on the rear side have three-dimensional shapes which are plane-symmetrical with a plane parallel to the up-down direction and the right-left direction as a symmetrical plane, as shown in FIG. 3. The lifting and lowering frame bases 51 and 52 each have a frame shape and support the lifting and lowering frame 31 between them such that it can move up and down along the direction perpendicular to the upper surface of the unit base 24.

Further, both the lifting and lowering frame bases 51 and 52 have plate-shaped liners 54 and 55 on the left side and the right side, and plate-shaped liners 56 on the front side and the rear side. The liners 54 and 55 stably guide a lifting and lowering motion along the direction perpendicular to the upper surface of the unit base 24 with respect to the front-side portion and the rear-side portion of the lifting and lowering frame 31. Further, the liners 56 stably guide a motion in the right-left direction.

Further, the lifting and lowering actuator 53 is a direct acting type actuator that imparts a reciprocating motion along the direction perpendicular to upper surface of the unit base 24 to the lifting and lowering frame 31, and for example, a hydraulic cylinder or the like can be used.

Pipe Holding Mechanism: Electrode

Each of the lower electrode 21 and the upper electrode 22 is a rectangular plate-shaped electrode in which a plate-shaped conductor is sandwiched between insulating plates.

A semicircular cutout is formed in each of the upper end portion at the center of the lower electrode 21 and the lower end portion at the center of the upper electrode 22 so as to perpendicularly penetrate the flat plate surface. Then, when the lower electrode 21 and the upper electrode 22 are disposed on the same plane and the upper end portion of the lower electrode 21 and the lower end portion of the upper electrode 22 are brought into close contact with each other, the semicircular cutouts are combined to form a circular through-hole. This circular through-hole substantially coincides with the outer diameter of the end portion of the metal pipe material P, and when the metal pipe material P is energized, the end portion thereof is gripped by the lower electrode 21 and the upper electrode 22 in a state of being fitted into the circular through-hole.

Further, the lower electrode 21 is electrically connected to a power source 101 that is controlled by the control device 100. The upper electrode 22 energizes the metal pipe material P through the lower electrode 21. The power source 101 is controlled by the control device 100 to energize the lower electrodes 21 of the right and left pipe holding mechanisms 20, and can rapidly heat the metal pipe material P by Joule heating.

The outer shape of the end portion of the metal pipe material P is not limited to a circular shape. Therefore, the cutout of each of the lower electrode 21 and the upper electrode 22 has a shape obtained by halving the outer shape of the end portion of the metal pipe material P.

Pipe Holding Mechanism: Electrode Mounting Unit

The electrode mounting unit 30 supports the lower electrode 21 and the upper electrode 22 while maintaining the direction in which the flat plate surfaces of the lower electrode 21 and the upper electrode 22 are perpendicular to the extension direction of the right end portion of the metal pipe material P described above. For example, as shown in FIG. 2, in a case where the upper surface of the unit base 24 is horizontal, the electrode mounting unit 30 supports the lower electrode 21 and the upper electrode 22 in the direction in which the flat plate surfaces of the lower electrode 21 and the upper electrode 22 become parallel in the up-down direction and the front-rear direction.

As shown in FIGS. 2 to 4, the electrode mounting unit 30 includes the lifting and lowering frame 31 that is subjected to the lifting and lowering motion along the direction perpendicular to the upper surface of the unit base 24 by the lifting and lowering mechanism 50 described above, a lower electrode frame 32 that holds the lower electrode 21 at the left end portion of the lifting and lowering frame 31, and an upper electrode frame 33 that is provided above the lower electrode frame 32 and holds the upper electrode 22.

The lower electrode frame 32 is a frame body that holds the outer periphery excluding the upper end portion of the lower electrode 21. The lower electrode frame 32 is supported by the left end portion of the lifting and lowering frame 31 so as to be movable along the direction parallel to the right-left direction when viewed in a plan view and parallel to the upper surface of the unit base 24 through two linear guides 321 provided at the front and the rear.

Further, the lower electrode frame 32 is provided with a lower electrode movement actuator 322, which imparts a moving motion along the moving direction by each linear guide 321. For the lower electrode movement actuator 322, for example, a hydraulic cylinder or the like can be used.

The lower electrode frame 32 is provided with a position sensor such as a linear sensor that detects a position in the moving direction by each linear guide 321.

With these configurations, the lower electrode 21 can reciprocate along the extension direction of the right end portion of the metal pipe material P.

Slide blocks 34 that are movable along the direction parallel to the right-left direction when viewed in a plan view and parallel to the upper surface of the unit base 24 are individually provided on the upper surfaces of the front end portion and the rear end portion of the lower electrode frame 32 through linear guides 341.

Further, the slide block 34 is provided with an upper electrode movement actuator 342 as a one-side electrode movement actuator that imparts a moving motion along the moving direction by each linear guide 341. For the upper electrode movement actuator 342, for example, a hydraulic cylinder or the like can be used.

The slide block 34 is provided with a position sensor such as a linear sensor that detects a position in the moving direction by each linear guide 341.

The upper electrode frame 33 is a frame body that holds the outer periphery excluding the lower end portion of the upper electrode 22. The upper electrode frames 33 is supported by each slide block 34 so as to be movable along the direction perpendicular to the upper surface of the unit base 24 through linear guides 331 provided two by two at the front and the rear at the upper portion of each slide block 34.

Further, an upper electrode levitation spring 332 is interposed between the upper electrode frame 33 and each slide block 34, and thus the upper electrode frame 33 is always pressed upward with respect to each slide block 34.

The upper electrode frame 33 is movable in the direction (the up-down direction) perpendicular to the upper surface of the unit base 24 with respect to each slide block 34. Then, each slide block 34 is movable in the direction (the right-left direction) parallel to the right-left direction when viewed in a plan view and parallel to the upper surface of the unit base 24 with respect to the lower electrode frame 32.

Therefore, the upper electrode frame 33 is movable up and down with respect to the lower electrode frame 32 and is movable along the extension direction (the right-left direction) of the end portion of the metal pipe material P.

Then, clamp actuators 333 for lifting and lowering the upper electrode frame 33 along the direction perpendicular to the upper surface of the unit base 24 are provided one by one at the front and the rear at the lower electrode frame 32. For each clamp actuator 333, for example, a hydraulic cylinder or the like can be used.

A tip portion of a plunger of each clamp actuator 333 is connected to the upper electrode frame 33 so as to movable along the extension direction (the right-left direction) of the end portion of the metal pipe material P. Therefore, the moving motion of the upper electrode frame 33 with respect to the lower electrode frame 32 along the extension direction (the right-left direction) of the end portion of the metal pipe material P is not hindered.

Pipe Holding Mechanism: Nozzle

The nozzle 23 is a cylinder into which the end portion of the metal pipe material P can be inserted. The center line of the nozzle 23 is supported by the nozzle mounting unit 40 so as to be parallel to the extension direction of the end portion of the metal pipe material P.

The inner diameter of the end portion of the nozzle 23 on the metal pipe material P side substantially coincides with the outer diameter of the metal pipe material P after expansion forming.

The nozzle 23 is provided with a pressing force sensor that detects the pressing force of the contact of the metal pipe material P.

Pipe Holding Mechanism: Nozzle Mounting Unit

The nozzle mounting unit 40 is mounted on the right end portion of the lifting and lowering frame 31 of the electrode mounting unit 30. Therefore, in a case where the lifting and lowering motion by the lifting and lowering mechanism 50 is performed, the nozzle mounting unit 40 moves up and down integrally with the electrode mounting unit 30.

The nozzle mounting unit 40 supports the nozzle 23 at a position where the end portion of the metal pipe material P and the nozzle 23 become concentric, in a state where the lower electrode 21 and the upper electrode 22 of the electrode mounting unit 30 grip the end portion of the metal pipe material P.

For example, as shown in FIG. 2, in a case where the upper surface of the unit base 24 is horizontal, the nozzle mounting unit 40 supports the nozzle 23 in the direction in which the center line of the nozzle 23 is parallel to the right-left direction.

As shown in FIG. 2, the nozzle mounting unit 40 has a hydraulic cylinder mechanism as a nozzle movement actuator that moves the nozzle 23 along the extension direction of the end portion of the metal pipe material P. This hydraulic cylinder mechanism is provided with a piston 41 that holds the nozzle 23, and a cylinder 42 that imparts a advancing and retreating movement to the piston 41.

The cylinder 42 is fixedly mounted on the right end portion of the lifting and lowering frame 31 in the direction in which the piston 41 advances and retreats in parallel with the extension direction of the end portion of the metal pipe material P. The cylinder 42 is connected to a hydraulic circuit 43 (FIG. 1), and pressure oil, which is a working fluid, is supplied to and discharged from the inside thereof.

In the hydraulic circuit 43, the supply and discharge of the pressure oil to and from the cylinder 42 is controlled by the control device 100.

The hydraulic circuit 43 is also connected to the pipe holding mechanism 20 on the left side. However, a path showing the connection is not shown in FIG. 1.

The piston 41 is provided with a main body 411 stored in the cylinder 42, a head portion 412 protruding from the left end portion (the electrodes 21 and 22 side) of the cylinder 42 to the outside, and a tubular portion 413 protruding from the right end portion of the cylinder 42 to the outside.

The main body 411, the head portion 412, and the tubular portion 413 each have a cylindrical shape and are concentrically and integrally formed.

The outer diameter of the main body 411 substantially coincides with the inner diameter of the cylinder 42. Then, in the cylinder 42, hydraulic pressure is supplied to both sides of the main body 411 to advance and retreat the piston 41.

The head portion 412 has a smaller diameter than the main body 411, and the nozzle 23 is concentrically and fixedly mounted to the tip portion on the left side (the electrodes 21 and 22 side) of the head portion 412.

The tubular portion 413 is a circular tube having a smaller diameter than the main body 411 and the head portion 412. The tubular portion 413 penetrates the right end portion of the cylinder 42 and protrudes to the outside of the cylinder 42.

The piston 41 is formed with a compressed gas flow path 414 that penetrates the center over the entire length from the head portion 412 to the tip of the tubular portion 413 through the main body 411. Then, the tip portion (right end portion) of the tubular portion 413 is connected to a pneumatic circuit 44 (FIG. 1) that supplies and discharges a compressed gas to and from the nozzle 23.

The pneumatic circuit 44 is also connected to the pipe holding mechanism 20 on the left side. However, a path showing the connection is not shown in FIG. 1.

Further, the nozzle 23 provided at the tip portion of the head portion 412 communicates with the compressed gas flow path 414.

That is, the nozzle mounting unit 40 has a structure capable of supplying the compressed gas to the nozzle 23 through the piston 41 from the side opposite to the nozzle 23.

The flow path 414 in the piston 41 does not need to be provided, and a configuration is also acceptable in which the compressed gas is directly supplied to the nozzle 23.

Forming Operation of Expansion Forming Apparatus

The expansion forming operation of the expansion forming apparatus 10 having the above configuration will be described based on the operation explanatory diagrams of FIGS. 5 to 11.

The forming operation described below is performed based on the operation control of the control device 100. Then, the control device 100 includes a storage unit that stores a processing program and various types of information related to the operation control, and a processing device that executes the operation control, based on the processing program.

First, the unit base 24 whose upper surface is inclined in the direction corresponding to the extension direction of the end portion of the metal pipe material P according to the target shape determined by the die 13 is selected and mounted to each pipe holding mechanism 20. Then, each pipe holding mechanism 20 is fixed to the upper surface of the base stage 15.

Figure 5:
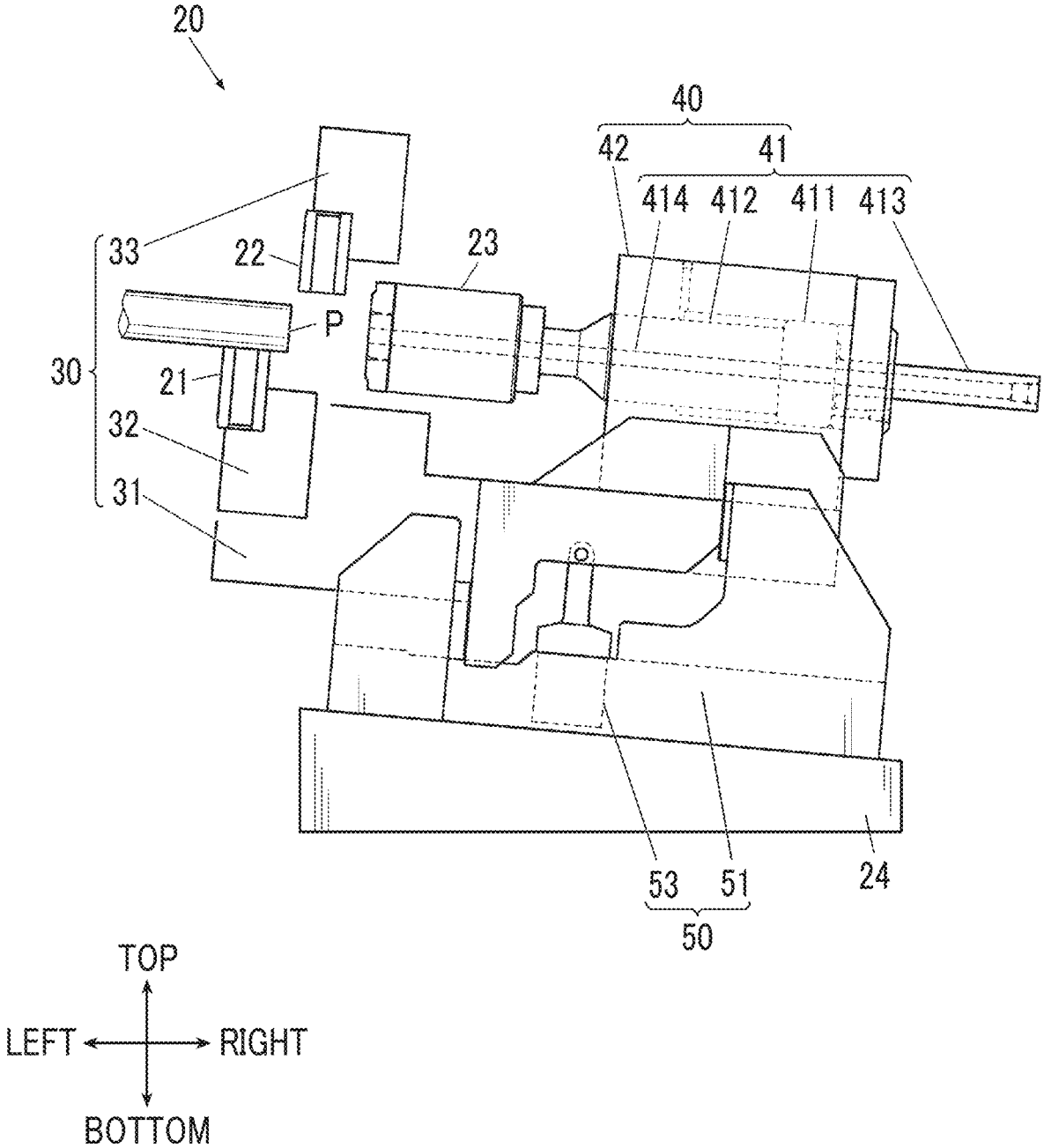
FIG. 5 is an operation explanatory diagram of the expansion forming apparatus.

Then, as shown in FIG. 5, the control device 100 controls the lower electrode movement actuators 322 of the right and left pipe holding mechanisms 20 to advance the lower electrodes 21 to the positions where they come into contact with the lower die 11.

Further, the control device 100 controls the upper electrode movement actuators 342 of the right and left pipe holding mechanisms 20 to retract the upper electrodes 22 with respect to the lower electrodes 21 to the positions separated from the end portions of the metal pipe material P.

The metal pipe material P is placed on the right and left lower electrodes 21 disposed in this way so as to be fitted into the semicircular cutout. Further, since the upper electrode 22 has been retracted, it does not interfere with the work of placing the metal pipe material P.

The metal pipe material P placed on the lower electrode 21 is located slightly above the lower die 11 and is not in contact with the lower die 11.

Figure 6:
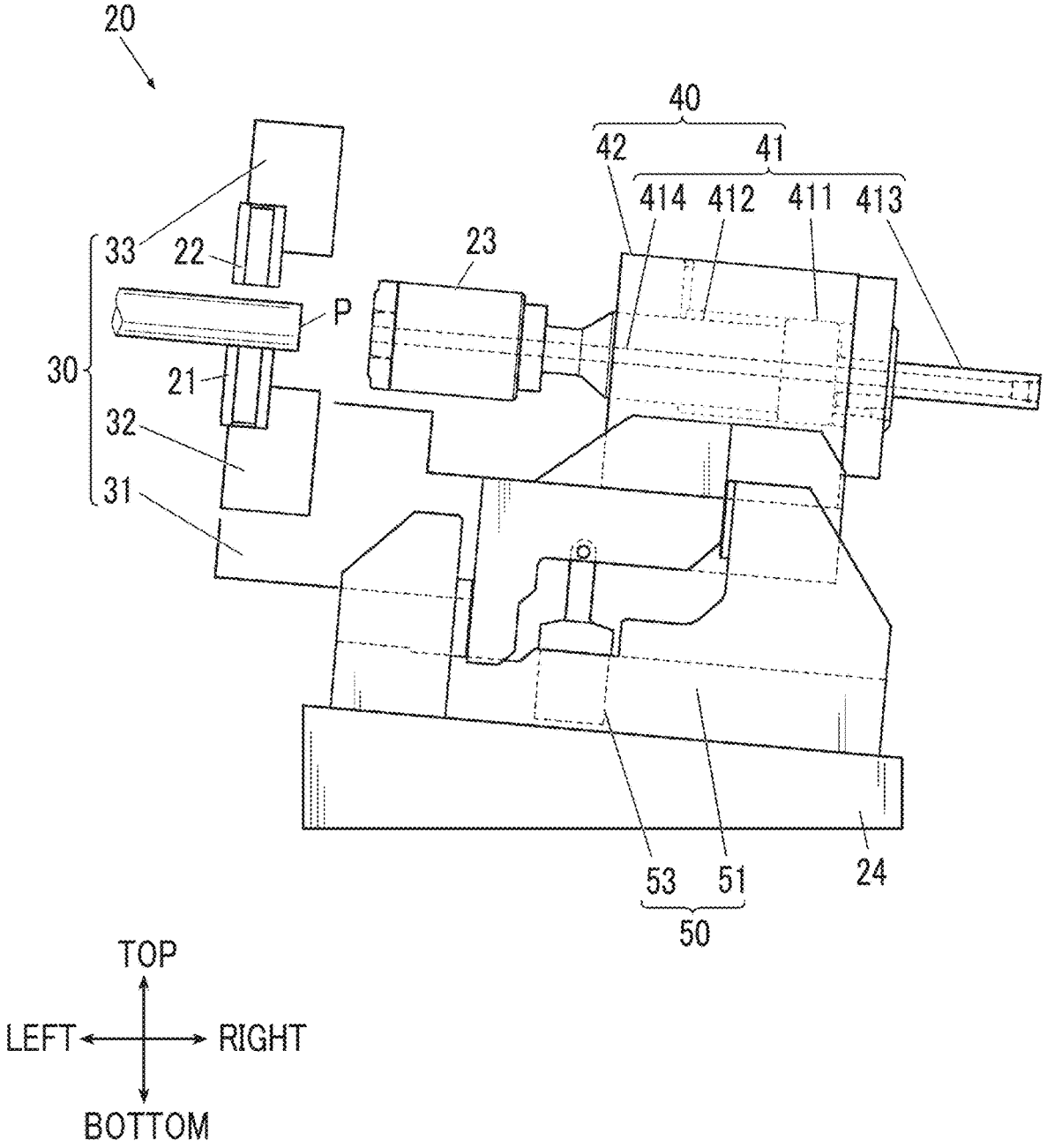
FIG. 6 is an operation explanatory diagram of the expansion forming apparatus following FIG. 5.

Next, as shown in FIG. 6, the control device 100 controls the upper electrode movement actuator 342 to move the upper electrode 22 to a gripping position above the lower electrode 21. The gripping position of the upper electrode 22 is the position where the upper electrode 22 is lowered toward the lower electrode 21 side, so that the end portion of the metal pipe material P can be gripped by them.

Figure 7:
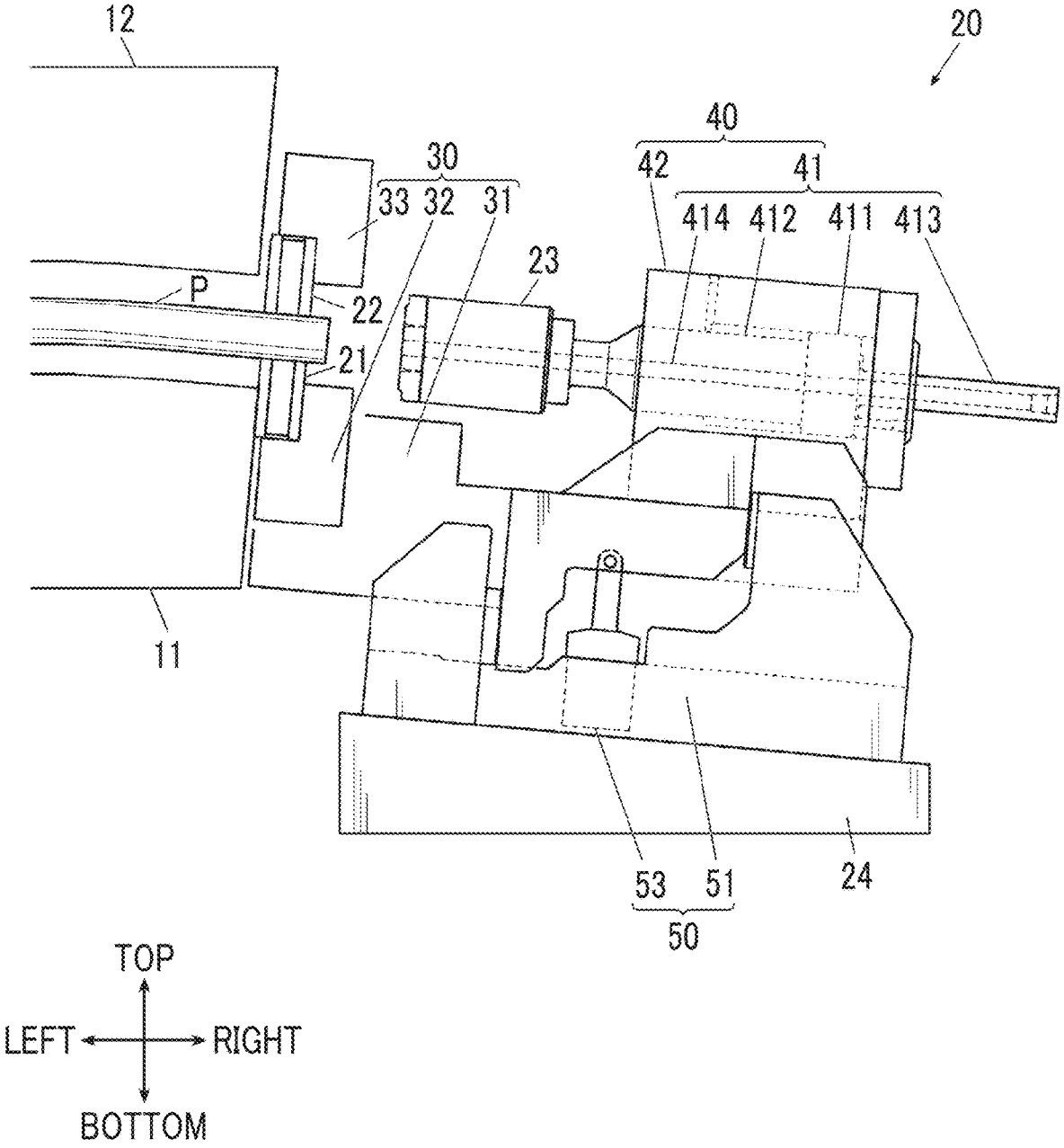
FIG. 7 is an operation explanatory diagram of the expansion forming apparatus following FIG. 6.

Next, as shown in FIG. 7, the control device 100 controls the clamp actuator 333 to lower the upper electrode 22 toward the lower electrode 21. In this way, the end portion of the metal pipe material P is fitted into the semicircular cutout of the upper electrode 22, and is gripped by the lower electrode 21 and the upper electrode 22.

In a state where both end portions of the metal pipe material P are individually gripped by the lower electrodes 21 and the upper electrodes 22 of the right and left pipe holding mechanisms 20, the control device 100 controls the power source 101 to energize the respective lower electrodes 21. In this way, the metal pipe material P is Joule-heated.

At this time, the control device 100 monitors the temperature of the metal pipe material P with the radiation thermometer 102 and performs heating for a defined time within a defined target temperature range.

Due to the Joule heating, the metal pipe material P is subjected to thermal expansion, and the end portion thereof extends in the extension direction thereof.

The control device 100 stores the correlation between the temperature and the amount of thermal extension of the metal pipe material P as data, and acquires the amount of thermal extension of the metal pipe material P, based on the temperature of the metal pipe material P detected by the radiation thermometer 102, with reference to this correlation data.

Further, the control device 100 controls the lower electrode movement actuator 322 from the acquired amount of thermal extension to moves the lower electrode 21 and the upper electrode 22 of each pipe holding mechanism 20 to the position where stress is not applied to the metal pipe material P or the position where stress is sufficiently reduced.

By performing this electrode position control, the control device 100 functions as an electrode position control unit.

This electrode position control is periodically and repeatedly executed while the lower electrodes 21 of the right and left pipe holding mechanisms 20 are being energized.

The electrode position control may perform control in which the lower electrode 21 and the upper electrode 22 move with respect to the end portion of the metal pipe material P while applying a weak tension that does not deform the metal pipe material P in the direction of extending in the extension direction, without using the correlation data between the temperature and the amount of thermal extension of the metal pipe material P.

In that case, in a case where the lower electrode movement actuator 322 is, for example, a hydraulic cylinder, the lower electrode 21 and the upper electrode 22 may be moved in the direction of extending in the extension direction with the hydraulic pressure set to the low pressure described above.

Figure 8:
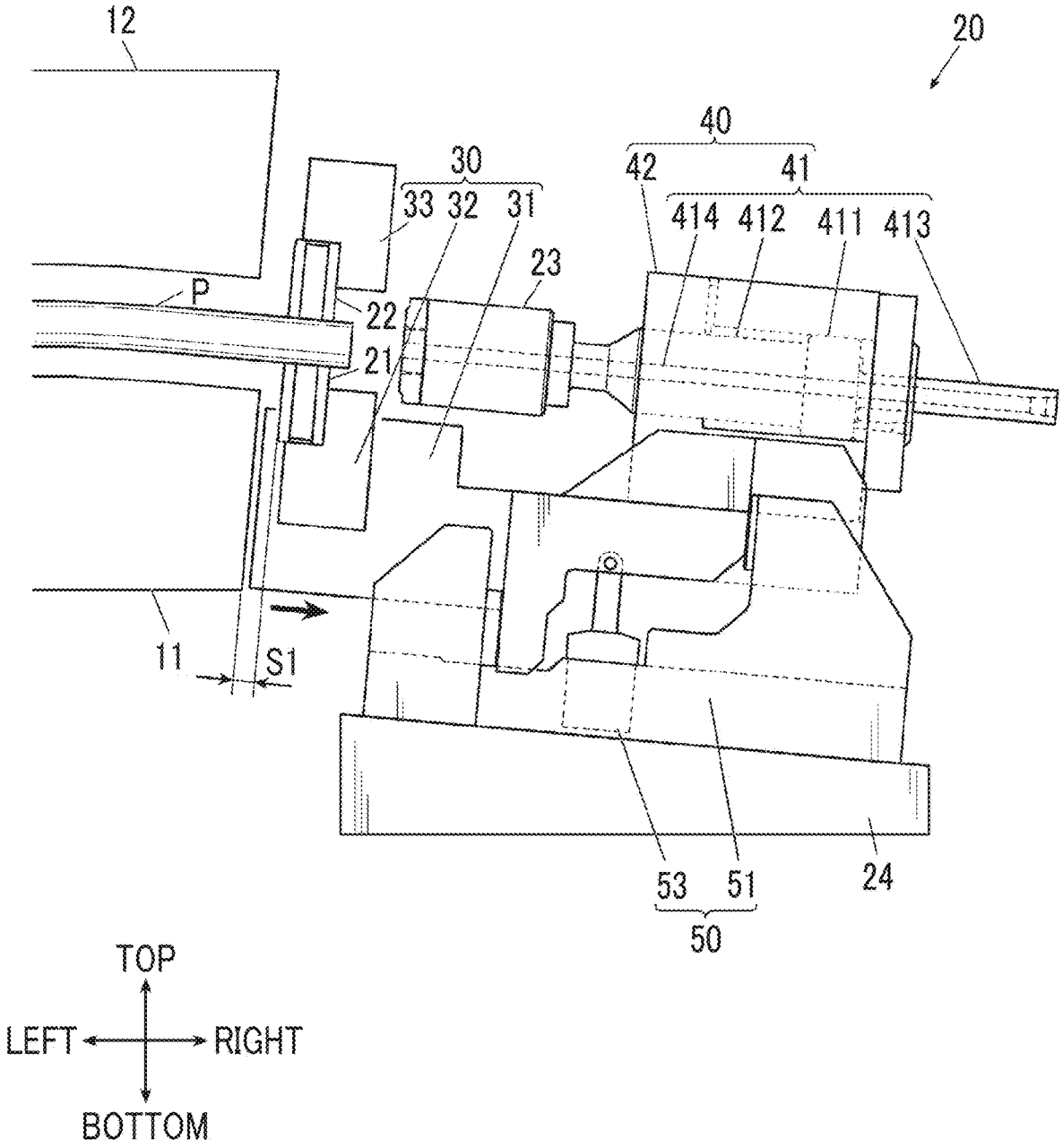
FIG. 8 is an operation explanatory diagram of the expansion forming apparatus following FIG. 7.

When the energization of the metal pipe material P ends, the lower electrode 21 is separated from the lower die 11 by the electrode position control, so that a gap S1 is generated, as shown in FIG. 8.

Figure 9:
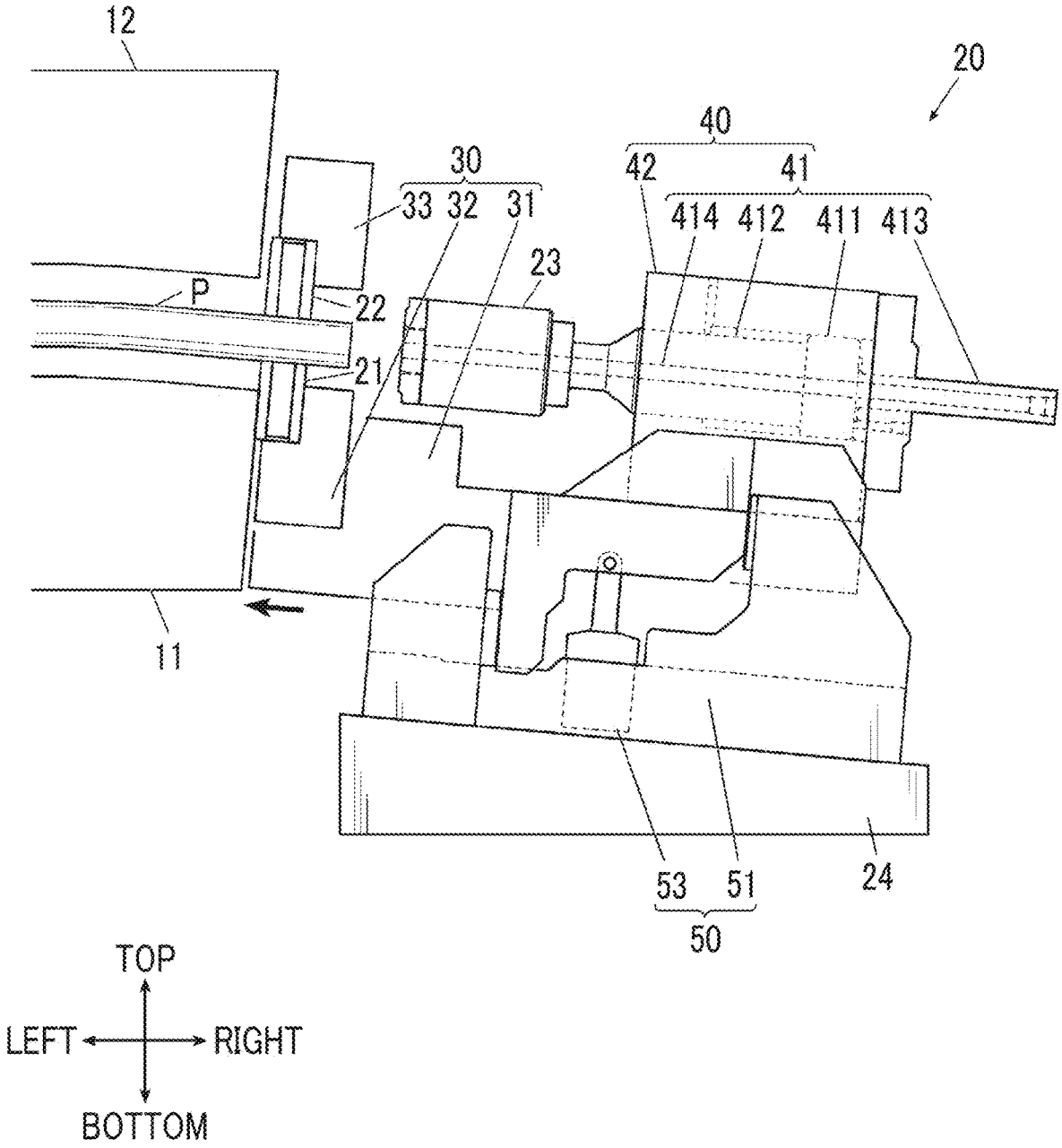
FIG. 9 is an operation explanatory diagram of the expansion forming apparatus following FIG. 8.

Therefore, as shown in FIG. 9, the control device 100 controls the clamp actuator 333 to move the upper electrode 22 up, and further controls the lower electrode movement actuator 322 to bring the lower electrode 21 and the upper electrode 22 closer to the die 13 side and bring the lower electrode 21 into contact with the lower die 11. Then, the upper electrode 22 is moved down to perform gripping again.

In this way, the control device 100 functions as a re-gripping operation control unit (re-contact operation control unit) that performs re-gripping operation control.

Figure 10:
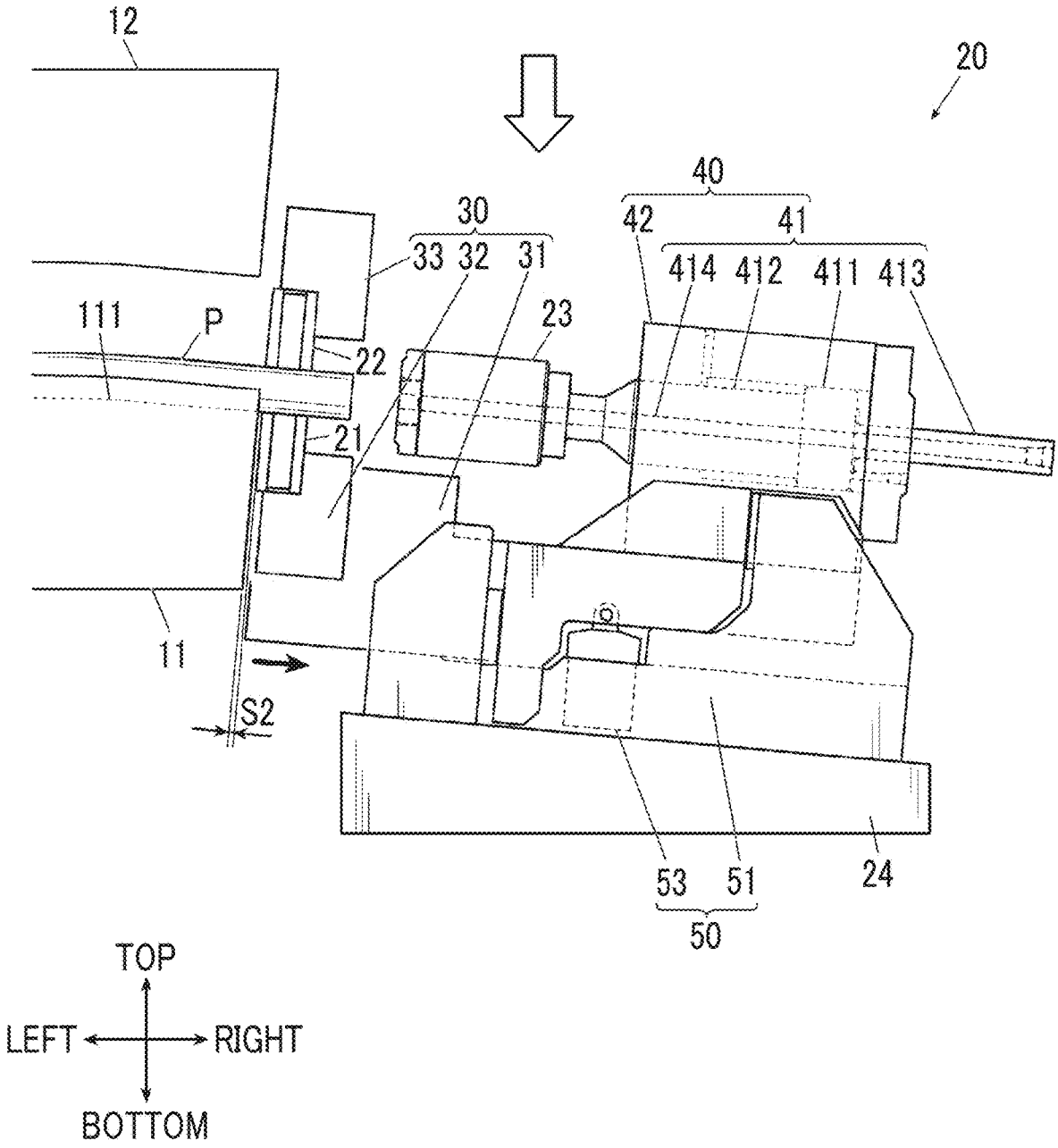
FIG. 10 is an operation explanatory diagram of the expansion forming apparatus following FIG. 9.

Next, as shown in FIG. 10, the control device 100 controls the lifting and lowering actuator 53 to move the metal pipe material P down to the position where it comes into contact with or approaches the recessed portion 111 of the lower die 11.

At this time, in a case where the upper surface of the unit base 24 is inclined with respect to the horizontal plane to correspond to the extension direction of the metal pipe material P, when a lowering operation is performed by the lifting and lowering actuator 53, all the configurations on the lifting and lowering frame 31 perform a change in position in the right-left direction. For example, the pipe holding mechanism 20 on the right side moves to the right, and the pipe holding mechanism 20 on the left side moves to the left.

As a result, the lower electrode 21 is separated from the lower die 11 to generate a gap S2.

Therefore, the control device 100 controls the clamp actuator 333 to move the upper electrode 22 up, and further controls the lower electrode movement actuator 322 to move the lower electrode 21 and the upper electrode 22 so as to come into contact with the die 13 side. Then, the upper electrode 22 is moved down to grip the end portion of the metal pipe material P again.

That is, the control device 100 performs the re-gripping operation control once more.

As described above, the case where the control device 100 performs the re-gripping operation control twice has been exemplified. However, the first re-gripping operation control at the time of the end of energization of the metal pipe material P shown in FIG. 8 is not executed, and the re-gripping operation control may be performed only once after the lower electrode 21 and the upper electrode 22 are moved down under the control of the lifting and lowering actuator 53.

Thereafter, the control device 100 controls the servomotor 83 of the upper die drive mechanism 80 to move the upper die 12 down to the position where it comes into contact with the lower die 11.

Further, the control device 100 controls the hydraulic circuit 43 to control the nozzle mounting units 40 of the right and left pipe holding mechanisms 20, and advances each nozzle 23 toward each end portion side of the metal pipe material P.

Figure 11:
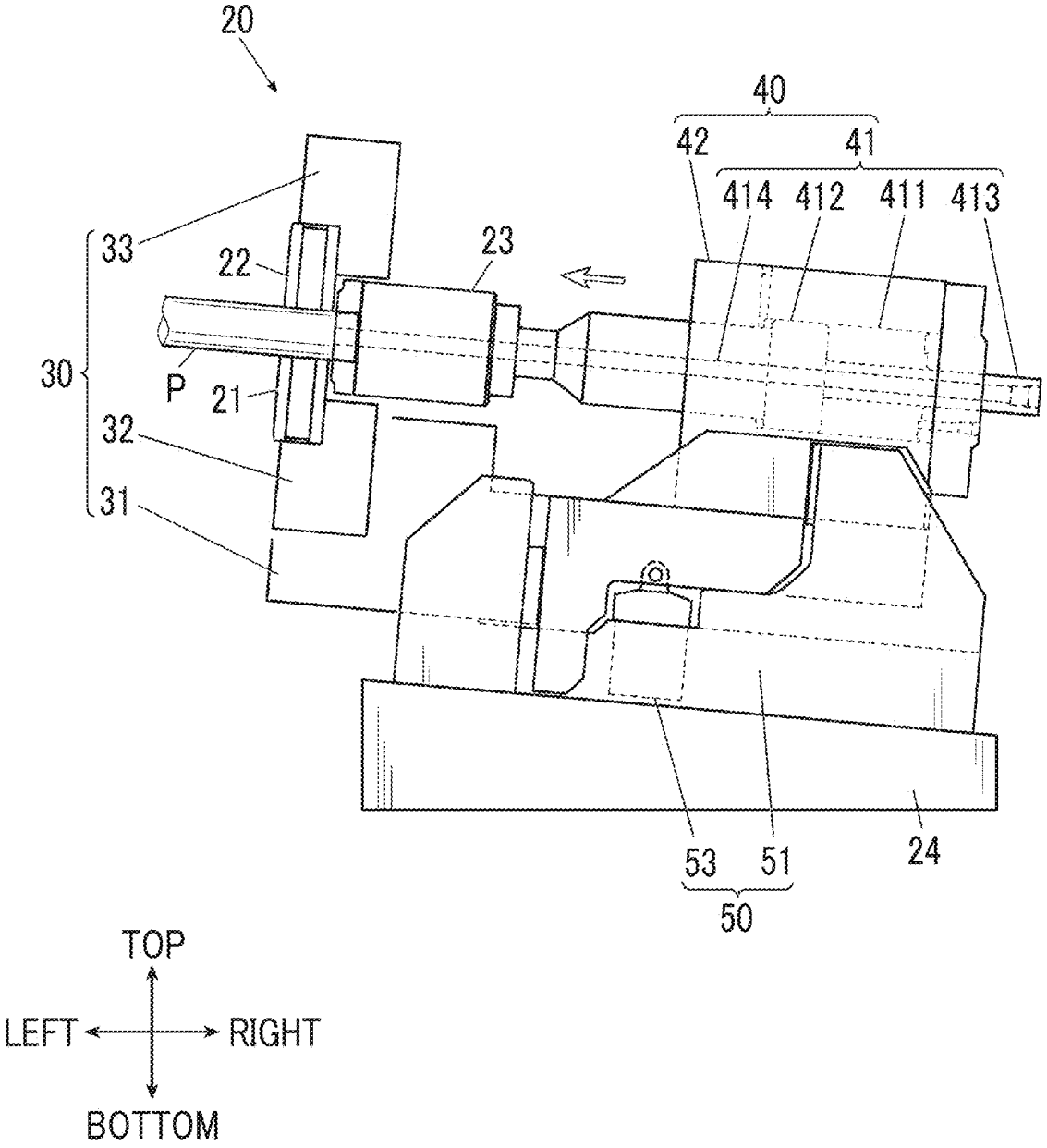
FIG. 11 is an operation explanatory diagram of the expansion forming apparatus following FIG. 10.

In this way, as shown in FIG. 11, the end portion of the metal pipe material P is inserted into the tip portion of the nozzle 23.

Then, the control device 100 controls the pneumatic circuit 44 to supply the compressed gas from the nozzle 23 into the metal pipe material P. In this way, the metal pipe material P whose hardness has been lowered due to the Joule heating is formed into the target shape in the die 13 by internal pressure.

On the other hand, the metal pipe material P shrinks as the temperature gradually decreases during the forming, and thus the end portion thereof moves to the die 13 side.

The control device 100 stores the correlation between the temperature and the amount of thermal extension of the metal pipe material P as data, as described above, and therefore, the control device 100 acquires the amount of shrinkage of the metal pipe material P, based on the temperature of the metal pipe material P detected by the radiation thermometer 102, with reference to this correlation data.

Further, the control device 100 controls the hydraulic circuit 43 from the acquired amount of shrinkage to operate the nozzle mounting unit 40 and move the nozzle 23 to the die 13 side. More specifically, the end portion of the metal pipe material P is moved to follow the amount of shrinkage of the metal pipe material P so as not to come off from the nozzle 23.

By performing the nozzle position control, the control device 100 functions as a nozzle position control unit.

The nozzle position control is periodically and repeatedly executed while the compressed gas is being supplied from the nozzle 23 into the metal pipe material P.

The nozzle position control may perform control in which an upper limit value is determined in advance within the range where the nozzle 23 does not give the influence of buckling, deformation, or the like to the end portion of the metal pipe material P and the nozzle 23 moves while applying a pressing force so as not to exceed the upper limit value, without using the correlation data between the temperature and the amount of thermal extension of the metal pipe material P.

Then, after the expansion forming is performed on the metal pipe material P by supplying the compressed gas for a certain period of time, the control device 100 stops the supply of the compressed gas, releases the gripping state by the lower electrode 21 and the upper electrode 22, and moves the upper die 12 up.

Further, the control device 100 controls the upper electrode movement actuator 342 of each pipe holding mechanism 20 to retract the upper electrode 22 in the direction away from the die 13. In this way, the formed metal pipe material P can be easily taken out from the expansion forming apparatus 10.

Technical Effects of Embodiment of Invention

In the expansion forming apparatus 10, the electrode mounting units 30 of a pair of pipe holding mechanisms 20 have the lower electrode movement actuators 322 that move the paired lower electrodes 21 and upper electrodes 22 along the extension direction of the end portion of the metal pipe material P.

Therefore, even in a case where the metal pipe material P extends due to the thermal expansion of Joule heating, the lower electrode 21 and the upper electrode 22 can be moved in the extension direction of the end portion of the metal pipe material P by the lower electrode movement actuator 322, and thus it becomes possible to effectively suppress the occurrence of deformation or buckling of the metal pipe material.

Further, the expansion forming apparatus 10 is provided with the unit base 24 that adjusts the moving directions of the lower electrode 21 and the upper electrode 22 by the lower electrode movement actuator 322 so as to follow the extension direction of the end portion of the metal pipe material P disposed in the die 13.

Therefore, even in a case where the metal pipe material P does not have a linear shape but is curved or bent, so that the end portion thereof extends in a non-horizontal direction, or a case where both end portions of the metal pipe material P extend in different directions, it is possible to move the lower electrode 21 and the upper electrode 22 along the extension direction.

Therefore, in the expansion forming apparatus 10, it becomes possible to perform good expansion forming on the curved or bent metal pipe material P by suppressing the occurrence of deformation or buckling.

Further, the expansion forming apparatus 10 is provided with the radiation thermometer 102 that detects the temperature of the metal pipe material P, and the control device 100 performs control as the electrode position control unit that performs the position control of the lower electrode 21 and the upper electrode 22 by the lower electrode movement actuator 322 according to the temperature detected by the radiation thermometer 102 during the energization heating.

Therefore, in a case where the metal pipe material P extends due to the thermal expansion of Joule heating, it is possible to move the lower electrode 21 and the upper electrode 22 to appropriate positions corresponding to the extension, and it becomes possible to more effectively suppress the occurrence of deformation or buckling of the metal pipe material.

Further, the control device 100 can also perform control as the electrode position control unit that performs the position control of the lower electrode 21 and the upper electrode 22 while applying a defined tension to the end portion of the metal pipe material P by the lower electrode movement actuator 322 during the energization heating of the metal pipe material P.

In this case, in a case where the metal pipe material P extends due to the thermal expansion of Joule heating, it is possible to eliminate stress that hinders the extension by the lower electrode 21 and the upper electrode 22, and it becomes possible to more effectively suppress the occurrence of deformation or buckling of the metal pipe material.

Further, in the expansion forming apparatus 10, the electrode mounting unit 30 is provided with the upper electrode movement actuator 342 that moves the upper electrode 22 with respect to the lower electrode 21 along the extension direction of the end portion of the metal pipe material P.

The upper electrode 22 can be disposed to be shifted in position with respect to the lower electrode 21, and in a case where the metal pipe material P is installed in or taken out from the expansion forming apparatus 10, it becomes possible to facilitate work without the upper electrode 22 getting in the way.

In particular, in a case where the installation work of the metal pipe material P in the expansion forming apparatus 10 is performed using a robot or the like, it is possible to easily perform the installation work by controlling the upper electrode movement actuator 342, and it becomes possible to provide an expansion forming apparatus suitable for automation.

Further, in the expansion forming apparatus 10, the nozzle mounting unit 40 has a hydraulic cylinder mechanism as the nozzle movement actuator that moves the nozzle 23 along the extension direction of the end portion of the metal pipe material P.

In a case where the metal pipe material P is expanded with high-pressure air after the Joule heating by the lower electrode 21 and the upper electrode 22, the expanded metal pipe material P shrinks due to a decrease in temperature. Even in such a case, the hydraulic cylinder mechanism of the nozzle mounting unit 40 can move the nozzle 23 to follow the end portion of the metal pipe material P that shrinks, and therefore, it becomes possible to suppress the detachment of the nozzle 23 or the leakage of the high-pressure air and to perform good expansion forming.

Further, also in the case of the nozzle mounting unit 40, the moving direction of the nozzle 23 can be adjusted by the unit base 24 so as to follow the extension direction of the end portion of the metal pipe material P disposed in the die 13, and therefore, the expansion forming apparatus 10 can perform good expansion forming by stably supplying the high-pressure air to the curved or bent metal pipe material P.

Further, in the expansion forming apparatus 10, the control device 100 performs control as the nozzle position control unit that performs the position control of the nozzle 23 by the hydraulic cylinder mechanism of the nozzle mounting unit 40 according to the temperature detected by the radiation thermometer 102, at the time of the supply of the compressed gas from the nozzle 23.

Therefore, in a case where the metal pipe material P shrinks due to a decrease in temperature after the Joule heating, it is possible to move the nozzle 23 to an appropriate position in response to the shrinkage, and it becomes possible to more effectively suppress the detachment of the nozzle 23 or the leakage of the high-pressure air and perform good expansion forming.

Further, the control device 100 can also perform control as the nozzle position control unit that performs the position control of the nozzle while applying a pressing force within a range not exceeding an upper limit value determined in advance to the end portion of the metal pipe material P by the hydraulic cylinder mechanism of the nozzle mounting unit 40, at the time of the supply of the compressed gas from the nozzle 23.

In this case, in a case where the metal pipe material P shrinks due to a decrease in temperature after the Joule heating, the nozzle 23 can be moved to follow the end portion of the metal pipe material P that shrinks, while applying a certain pressing force, and therefore, it becomes possible to more effectively suppress the detachment of the nozzle 23 or the leakage of the high-pressure air and perform good expansion forming.

Further, in the nozzle mounting unit 40, the compressed gas flow path 414 of the nozzle 23 is formed to penetrate from the piston 41 to the end portion of the cylinder 42 on the side opposite to the end portion side of the metal pipe material P.

Many configurations related to the forming of the metal pipe material P, such as the lower electrode 21, the upper electrode 22, and the electrode mounting unit 30, are densely disposed around the nozzle 23, and thus it is difficult to secure a space for installing a hose or a pipe for supplying the compressed gas to the movable nozzle 23.

Therefore, by making the compressed gas flow path 414 penetrate to the end portion of the cylinder 42 on the side opposite to the end portion side of the metal pipe material P, it becomes possible to dispose the hose or the pipe for supplying the compressed gas while avoiding a region where various configurations are densely disposed. Further, in this way, it is possible to reduce the hose or the pipe interfering with other configurations when the nozzle 23 advances and retreats, and it becomes possible to stably perform the expansion forming while avoiding damage to each part.

Further, in the expansion forming apparatus 10, the lifting and lowering mechanism 50 is provided with the lifting and lowering actuator 53 which lifts and lowers the lower electrode 21 and the upper electrode 22. The lifting and lowering actuator 53 also lifts and lowers the nozzle 23 together with the lower electrode 21 and the upper electrode 22.

Therefore, it becomes possible to perform the installation work or the removal work of the metal pipe material P with respect to the die 13, and it becomes possible to facilitate and speed up the work.

Further, the height of the metal pipe material P with respect to the die 13 can also be adjusted by the lifting and lowering actuator 53, and the adjustment work can be facilitated.

Further, the control device 100 of the expansion forming apparatus 10 performs control as the re-gripping operation control unit that changes the gripping position of the metal pipe material P by the lower electrode 21 and the upper electrode 22 to the position closer to the die side than the position at the time of the start of the energization heating between the start of the energization heating by the lower electrode 21 and the upper electrode 22 and the start of the supply of the compressed gas by the nozzle 23.

Therefore, even in a case where a gap is generated between the lower electrode 21 and the upper electrode 22, and the die 13, due to the thermal expansion of the metal pipe material P, the gripping position is changed to the position closer to the die side, and therefore, it becomes possible to suppress the occurrence of the gap.

In that case, when a gap is generated, it becomes possible to suppress the occurrence of the expansion deformation of the gap portion due to the supply of the compressed gas to the metal pipe material P, and it becomes possible to maintain high forming quality.

Other

Each embodiment of the present invention has been described above. However, the present invention is not limited to each embodiment described above. The details shown in each embodiment can be appropriately changed within a scope which does not depart from the gist of the invention.

For example, in the embodiment described above, the expansion forming apparatus 10 provided with the main cylinder 84 based on hydraulic pressure as the drive source for moving the slide 82 has been exemplified. However, the drive source is not limited thereto.

For example, a configuration may be made in which a servomotor is provided as the drive source for performs the lifting and lowering motion of the slide 82 and provides the lifting and lowering motion to the slide 82 through a crank mechanism.

Further, the metal pipe material has been exemplified as the metal material. However, the forming target does not need to have a pipe shape.

Further, in the expansion forming apparatus 10, the case where the extension direction of the end portion of the metal pipe material P, which is defined by the die 13, is the direction inclined downward with respect to the right-left direction (the horizontal direction) has been exemplified. However, there is no limitation thereto. For example, the extension direction of the end portion of the metal pipe material P, which is defined by the die 13, may be the direction inclined downward with respect to the right-left direction (the horizontal direction), or may be an oblique direction in which the front-rear direction, the right-left direction, and the up-down direction are combined. In either case, by using the unit base 24 in which the upper surface of the unit base 24 is inclined at an angle corresponding to a corresponding direction and the direction of the pipe holding mechanism 20 is rotated and adjusted around an axis along the up-down direction and fixed to the base stage 15, it is possible to correspond to the extension direction of the end portion of the metal pipe material P inclined in each direction.

Further, in a case where the extension direction of the end portion of the metal pipe material P, which is defined by the die 13 is held in the inclined direction in which the right-left direction and the front-rear direction that are the horizontal directions are combined, the position displacement in the right-left direction does not occur when the lifting and lowering frame 31 is moved down, as in the case shown in FIG. 10 which is the operation explanatory diagram described above, and therefore, the re-gripping operation control when the lifting and lowering frame 31 is moved down is not required and the operation control can be simplified.

Further, as the lifting and lowering mechanism 50 of the pipe holding mechanism 20, the configuration has been exemplified in which the electrode mounting unit 30 and the nozzle mounting unit 40 are integrally moved up and down. However, a configuration may be made in which the electrode lifting and lowering actuator that moves the electrode mounting unit 30 up and down and the nozzle lifting and lowering actuator that moves the nozzle mounting unit 40 up and down are individually provided and they can be individually lifted and lowered, making it possible for the electrode mounting unit 30 and the nozzle mounting unit 40 to individually moves up and down.

Further, the case where the electrode position control unit, the nozzle position control unit, and the re-gripping operation control unit described above function as the respective control units by the execution of a program by the control device 100 has been exemplified. However, there is no limitation thereto.

For example, the electrode position control unit, the nozzle position control unit, and the re-gripping operation control unit may be configured with individual processing devices or individual circuits.

The expansion forming apparatus according to the present invention has industrial applicability for an expansion forming apparatus that heats a metal material with an electrode.

It should be understood that the invention is not limited to the above-described embodiment, but may be modified into various forms on the basis of the spirit of the invention. Additionally, the modifications are included in the scope of the invention.

What is claimed is:

1. An expansion forming apparatus that shapes a metal material with a die, comprising:

an electrode that comes into contact with the metal material and performs energization heating;

an electrode mounting unit having an electrode movement actuator that moves the electrode along an extension direction of the metal material during heating; and an electrode adjustment unit that adjusts a moving direction of the electrode by the electrode mounting unit so as to follow the extension direction of the metal material disposed in the die, wherein the metal material has a linear shape parallel to a right-left direction which is curved or bent in a middle and is held such that both right and left end portions are inclined downward, the electrode adjustment unit is a substantially rectangular plate-shaped block when viewed in a plan view, and is mounted on and dismounted from an upper surface of a base stage, which is a horizontal plane, by fixing means, a plurality of the electrode adjustment units in which inclination angles of upper surfaces are different from each other are provided, and inclination angles of the electrode and the electrode mounting unit are collectively changed and regulated by exchanging the electrode adjustment units.

2. The expansion forming apparatus according to claim 1, wherein the inclination angle of the upper surface of the electrode adjustment unit coincides with an inclination angle of the extension direction of the metal material.

3. An expansion forming apparatus that shapes a metal material with a die, comprising:

an electrode configured to come into contact with an end portion of the metal material and perform energization heating; and an electrode movement mechanism configured to move the electrode along an extension direction of the end portion of the metal material such that the electrode is moved away from the die during energization heating, and move the electrode closer to the die such that the electrode grips the metal material, after energization heating and before a compressed gas is supplied into the metal material.

4. The expansion forming apparatus according to claim 3, wherein the metal material is a metal pipe material.

5. The expansion forming apparatus according to claim 3, wherein the electrode movement mechanism is configured to move the electrode so as to come into contact with the die.

6. The expansion forming apparatus according to claim 3, wherein the electrode movement mechanism is provided with an electrode movement actuator.

7. The expansion forming apparatus according to claim 3, wherein the electrode includes a first electrode and a second electrode, and the electrode movement mechanism is provided with an electrode movement actuator configured to move, before the energization heating, the second electrode along the extension direction of the end portion of the metal material, and to move, after moving the second electrode along the extension direction of the end portion of the metal material, the second electrode toward the first electrode so as to cause the second electrode to come into contact with the end portion of the metal material.

8. The expansion forming apparatus according to claim 3, wherein the extension direction of the end portion of the metal material is a direction in which a center line at the end portion of the metal material linearly extends during the energization heating.

9. The expansion forming apparatus according to claim 7, wherein the first electrode and the second electrode are configured to be in contact with the metal material during the energization heating.

10. The expansion forming apparatus according to claim 7, wherein the first electrode and the second electrode are configured to grip, during the energization heating, the metal material.

11. The expansion forming apparatus according to claim 3, further comprising:

a temperature detection unit configured to detect, during the energization heating, a temperature of the metal material; and an electrode position control unit configured to perform, according to the temperature detected by the temperature detection unit, position control of the electrode by the electrode movement mechanism.

12. The expansion forming apparatus according to claim 3, further comprising:

an electrode lifting and lowering actuator configured to move the electrode up and down.

13. The expansion forming apparatus according to claim 3, further comprising:

a nozzle configured to supply a compressed gas to an interior of the metal material; and a nozzle mounting unit comprising a nozzle movement actuator configured to move the nozzle along the extension direction of the end portion of the metal material.

14. The expansion forming apparatus according to claim 13, further comprising:

a nozzle adjustment unit configured to adjust a moving direction of the nozzle by the nozzle mounting unit so as to follow the extension direction of the end portion of the metal material.

15. The expansion forming apparatus according to claim 13, further comprising:

a nozzle position control unit configured to perform position control of the nozzle while applying a pressing force within a range not exceeding an upper limit value determined in advance to the metal material by the nozzle movement actuator when supplying the compressed gas from the nozzle.

16. The expansion forming apparatus according to claim 13, further comprising:

a nozzle lifting and lowering actuator configured to move the nozzle up and down.

* * * * *